US007906466B2

(12) United States Patent
Okazaki

(10) Patent No.: US 7,906,466 B2
(45) **Date of Patent: *Mar. 15, 2011**

(54) FINISHED LUBRICANT WITH IMPROVED RUST INHIBITION

(75) Inventor: Mark E. Okazaki, Alameda, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/650,183

(22) Filed: Dec. 30, 2009

(65) Prior Publication Data

US 2010/0173809 A1 Jul. 8, 2010

Related U.S. Application Data

(63) Continuation of application No. 12/256,795, filed on Oct. 23, 2008, now Pat. No. 7,651,986.

(51) Int. Cl.
*C10M 135/36* (2006.01)
*C10M 135/32* (2006.01)
*C10G 71/00* (2006.01)

(52) U.S. Cl. ..... 508/273; 508/284; 208/19

(58) Field of Classification Search ..... 508/273, 508/284; 208/18, 19

See application file for complete search history.

(56) References Cited

U.S. PATENT DOCUMENTS

| | | | |
|---|---|---|---|
| 4,267,064 | A | 5/1981 | Sasaki et al. |
| 4,417,088 | A | 11/1983 | Miller |
| 4,434,308 | A | 2/1984 | Larkin et al. |
| 4,655,946 | A | 4/1987 | Metro et al. |
| 4,701,273 | A | 10/1987 | Brady et al. |
| 4,721,823 | A | 1/1988 | Venier et al. |
| 4,827,064 | A | 5/1989 | Wu |
| 4,827,073 | A | 5/1989 | Wu |
| 4,849,566 | A | 7/1989 | Venier et al. |
| 4,929,782 | A | 5/1990 | Venier et al. |
| 4,960,542 | A | 10/1990 | Seiki |
| 4,990,709 | A | 2/1991 | Wu |
| 5,012,022 | A | 4/1991 | Venier et al. |
| 5,012,023 | A | 4/1991 | Venier et al. |
| 5,104,558 | A | 4/1992 | Matsuzaki |
| 5,135,638 | A | 8/1992 | Miller |
| 5,246,566 | A | 9/1993 | Miller |
| 5,282,958 | A | 2/1994 | Santilli et al. |
| 5,362,378 | A | 11/1994 | Borghard et al. |
| 5,565,086 | A | 10/1996 | Cody et al. |
| 5,582,760 | A | 12/1996 | Kim et al. |
| 5,585,029 | A | 12/1996 | Kim et al. |
| 5,587,355 | A | 12/1996 | Beltzer et al. |
| 5,679,627 | A | 10/1997 | Beltzer et al. |
| 5,750,478 | A | 5/1998 | Kim et al. |
| 5,789,358 | A | 8/1998 | BErlowitz et al. |
| 5,801,130 | A | 9/1998 | Francisco et al. |
| 5,942,470 | A | 8/1999 | Norman |
| 6,127,324 | A | 10/2000 | Tolfa et al. |
| 6,180,575 | B1 | 1/2001 | Nipe |
| 6,337,010 | B1 | 1/2002 | Hofer |
| 6,398,946 | B1 | 6/2002 | O'Rear et al. |
| 6,518,473 | B2 | 2/2003 | Miller et al. |
| 6,605,206 | B1 | 8/2003 | Johnson et al. |
| 7,651,986 | B2 * | 1/2010 | Okazaki ..... 508/273 |
| 2004/0033908 | A1 | 2/2004 | Deckman et al. |
| 2004/0241309 | A1 | 12/2004 | Garmier |
| 2005/0133409 | A1 | 6/2005 | Abernathy et al. |

FOREIGN PATENT DOCUMENTS

| | | | |
|---|---|---|---|
| DE | 4404804 | A | 8/1995 |
| EP | 0378176 | A | 7/1990 |
| EP | 0402009 | A | 12/1990 |
| EP | 0460317 | A | 12/1991 |
| EP | 321302 | | 5/1992 |
| EP | 321304 | | 5/1993 |
| EP | 0647701 | A | 4/1995 |
| EP | 0736591 | A | 10/1996 |
| EP | 710710 | | 3/2000 |
| EP | 0997519 | A | 5/2000 |
| EP | 765374 | | 12/2001 |

OTHER PUBLICATIONS

*Synthetic Lubricants and High-Performance Functional Fluids*, edited by Ronald L. Shubkin, 1993, pp. 125-144.

*Synthetic Lubricants and High-Performance Functional Fluids*, edited by Ronald L. Shubkin, 1993, pp. 41-65.

Ciba® IRGALUBE® 349, product data sheet, 7 pages, Printing Date: Jul. 1997, Publ. No. 28978/96/e, Edited in Switzerland.

Ciba® IRGACOR® L 12, product data sheet, 5 pages, Printing Date: Jul. 1997, Publ. No. 28989/96/e, Edited in Switzerland.

* cited by examiner

*Primary Examiner* — Walter D Griffin
*Assistant Examiner* — Frank C Campanell
(74) *Attorney, Agent, or Firm* — Susan M. Abernathy

(57) ABSTRACT

A finished lubricant having a kinematic viscosity at 40° C. between about 90 and 1700 cSt that passes the 4 hour TORT B rust test, comprising:

a) greater than 65 weight percent API Group III base oil, API Group IV base oil, polyinternal olefin base oil, or mixtures thereof; and b) between about 0.10 wt % and about 5 wt % solubility improver. The solubility improver has an aniline point less than 50° C., or even lower. The finished lubricant can additionally comprise a mixture of amine phosphates.

11 Claims, No Drawings

FINISHED LUBRICANT WITH IMPROVED RUST INHIBITION

This application is a continuation of U.S. patent application Ser. No. 12/256,795, filed Oct. 23, 2008; herein incorporated in its entirety.

FIELD OF THE INVENTION

This invention is directed to finished lubricants with improved rust inhibition. The improved rust inhibitor gives protection against rust in synthetic seawater as measured by ASTM D 665-02 when blended with highly paraffinic lubricating base oils.

BACKGROUND OF THE INVENTION

It is very difficult to get effective rust inhibition in finished oils comprising highly paraffinic lubricating base oils. Highly paraffinic lubricating base oils include API Group II base oils having greater than 65% paraffinic chain carbons by ASTM D 3238, API Group III base oils having greater than 65% paraffinic chain carbons by ASTM D 3238, API Group IV base oils, polyinternal olefins, hydroisomerized Fischer-Tropsch wax, and Fischer-Tropsch oligomerized olefins. Others have approached this problem by using synergistic mixtures of different additives, and base oil blends to reduce the amount of highly paraffinic base oil in the finished oil. However, the current approaches have still not provided consistent passes in the 4 hour TORT B rust test using synthetic seawater, by ASTM D 665-02. The problem is notably more acute with higher viscosity oils, of ISO 100 grade or higher.

Others have made lubricant compositions with good rust inhibition, but these earlier compositions either had a different rust inhibitor formulation and/or they were made using different base oils than in the preferred embodiments of this invention. For example, U.S. Pat. No. 4,655,946 discloses a turbine engine oil that is resistant to seawater corrosion comprising a specific additive mixture different than what is disclosed in this invention, and preferably comprising a synthetic ester base oil. U.S. Pat. No. 4,701,273 describes lubricant compositions with good metal deactivation comprising antioxidants, amine phosphates and a preferred benzotriazole derivative.

There are a number of patents describing dual phosphorus and sulfur additives combined with amine phosphates for making superior load-carrying lubricants. These patents include U.S. Pat. No. 5,801,130; U.S. Pat. No. 5,789,358; U.S. Pat. No. 5,750,478; U.S. Pat. No. 5,679,627; U.S. Pat. No. 5,587,355; U.S. Pat. No. 5,585,029; and U.S. Pat. No. 5,582,760. None of these patents teach lubricating oils made with highly paraffinic base oils that have effective rust inhibition in seawater.

U.S. Pat. No. 6,180,575 teaches lubricating oils with anti-rust characteristics based on high quality base oils such as polyalphaolefins or hydroisomerized wax (petroleum or Fischer-Tropsch) with a secondary base oil, preferably a long chain alkylated aromatic. A synergistic combination of additives is used which is different than those of this invention. Unlike this invention, the additive mixture does not comprise a mixture of phosphate amines. The lubricating oils in U.S. Pat. No. 6,180,575 contain solubility improvers at levels much higher than are needed with preferred embodiments of our invention.

U.S. Pat. No. 5,104,558 teaches a rust-proofing oil composition for use in the surface treatment of steel sheets comprising at least one of a mineral oil and a synthetic oil as a base oil having a kinematic viscosity at 40° C. in the range of 5-50 cSt. The synthetic oil useful in U.S. Pat. No. 5,104,558 is selected from the group consisting of polybutene, alpha-olefin oligomer, alkylbenzene, alkylnaphthalene, diester, polyol ester, polyglycol, polyphenyl ether, tricresyl phosphate, silicone oil, perfluoroalkyl ether, normal paraffin and isoparaffin. Although this earlier patent included alkylnaphthalene and polyol ester as synthetic oils useful in the composition, there was no selection or understanding of the synthetic oil being potentially important as a solubility improver to improve rust inhibition. Alkylnaphthalene and polyol ester were grouped with other synthetic oils with high aniline points which are not the solubility improvers of this invention. U.S. Pat. No. 5,104,558 also used different rust inhibiting additives than those of this invention.

SUMMARY OF THE INVENTION

This invention provides a finished lubricant having a kinematic viscosity at 40° C. between about 90 and 1700 cSt that passes the 4 hour TORT B rust test, comprising: greater than 65 weight percent API Group III base oil, API Group IV base oil, polyinternal olefin base oil, or mixtures thereof; and between about 0.10 wt % and about 5 wt % solubility improver having an aniline point less than 50° C.

This invention also provides a finished lubricant comprising a major amount of hydroisomerized Fischer-Tropsch wax, Fischer-Tropsch oligomerized olefins, or mixture thereof; and between about 0.10 and about 5 wt % of a solubility improver having an aniline point less than 10° C.; wherein the finished lubricant passes the 4 hour TORT B rust test.

This invention also provides a process for making a lubricant, comprising blending together: a) about 0.001 to about 2 wt %, based on the total weight of the lubricant, of a mixture of amine phosphates; b) about 0.001 to about 0.5 wt %, based on the total weight of the lubricant, of an alkenyl succinic compound selected from the group consisting of an acid half ester, an anhydride, an acid, and mixtures thereof; c) about 0.10 to about 20 wt %, based on the total weight of the lubricant, of a solubility improver having an aniline point less than 20° C.; and d) about 60 to about 98.5 wt %, based on the total weight of the mixture, of a lubricating base oil selected from the group consisting of an API Group II base oil having greater than 65% paraffinic chain carbons by ASTM D 3238, an API Group III base oil having greater than 65% paraffinic chain carbons by ASTM D 3238, an API Group IV base oil, a polyinternal olefin base oil, a hydroisomerized Fischer-Tropsch wax, a Fischer-Tropsch oligomerized olefin base oil, and mixtures thereof; wherein the lubricant passes the 4 hour TORT B rust test.

DETAILED DESCRIPTION OF THE INVENTION

A rust inhibitor is an additive that is mixed with lubricating base oil to prevent rust in finished lubricant applications. Examples of commercial rust inhibitors are metal sulfonates, alkylamines, alkyl amine phosphates, alkenyl succinic acids, fatty acids, and acid phosphate esters. Rust inhibitors are sometimes comprised of one or more active ingredients. Examples of applications where rust inhibitors are needed include: internal combustion engines, turbines, electric and mechanical rotary machinery, hydraulic equipment, gears, and compressors. Rust inhibitors work by interacting with steel surfaces to form a surface film or neutralize acids. The rust inhibitors of this invention are effective in finished lubricants when they are used in an amount less than 25 weight percent, preferably in an amount less than 10 weight percent of the total composition. In preferred embodiments they provide effective rust inhibition in lubricating oils in an amount less than 1 weight percent.

Rust inhibition of lubricating oils is determined using ASTM D 665-02. ASTM D 665-02, the disclosure of which is incorporated herein by reference, is directed at a test for determining the ability of oil to aid in preventing the rusting of ferrous parts should water become mixed with the oil. In this test a mixture of 300 ml. of the test oil is stirred with 30 ml. of distilled or synthetic seawater at a temperature of 60° C. with a cylindrical steel specimen completely immersed therein for 4 hours, although longer and shorter periods of time also may be utilized. TORT A refers to the ASTM D 665-02 rust test using distilled water. TORT B refers to the ASTM D 665-02 rust test using synthetic seawater. The TORT A and TORT B rust test results are reported as either a "pass" or a "fail."

Generally, finished lubricants made with highly paraffinic lubricating base oils, especially those with high kinematic viscosities, are very difficult to formulate into finished lubricants that may consistently pass the 4 hour TORT B rust test using synthetic seawater. The rust inhibitor of this invention for the first time provides consistent passes in the 4 hour TORT B rust test using synthetic seawater when used with highly paraffinic lubricating base oils, even with lubricating base oils with high kinematic viscosities.

Highly paraffinic lubricating base oils include API Group II, API Group III, API Group IV, polyinternal olefins, hydroisomerized Fischer-Tropsch wax, and Fischer-Tropsch oligomerized olefins. For those highly paraffinic lubricating base oils that are API Group II and API Group III, in the context of this disclosure, "highly paraffinic" is defined by a level of between greater than 65 wt % and 100 wt % paraffinic chain carbons by ASTM D 3238.

In the context of this disclosure "a major amount" of a component in a formulation is greater than 50 weight percent.

Solubility Improvers:

Solubility improvers useful in this invention are liquids having low aniline points that are compatible with lubricating base oils. Preferably they will have a kinematic viscosity within the lubricating base oil range (2.0-75 cSt at 100° C.). Their aniline point will be less than 100° C., preferably less than 50° C., more preferably less than 20° C. Aniline points tend to increase with molecular weight or viscosity and decrease with increasing naphthenics and aromatics content. Examples of suitable solubility improvers are certain conventional mineral oils and synthetic lubricants such as alkylated aromatics, organic esters, alkylated cyclopentadiene or alkylated cyclopentene. Naturally occurring and synthetic organic esters may be used as solubility improvers.

Aniline point is the lowest temperature at which equal volumes of aniline is soluble in a specified quantity of a petroleum product, as determined by test method ASTM D 611-01a; hence, it is an empirical measure of the solvent power of a hydrocarbon. Generally, the lower the aniline point of a hydrocarbon the greater the solvency of the hydrocarbon. Paraffinic hydrocarbons have higher aniline points than aromatic hydrocarbons. Some typical aniline points for different types of lubricating base oils are: polyalphaolefin (API Group IV)->115° C., API Group III->115° C., API Group II->102° C., API Group I-80 to 125° C.

The amount of solubility improver in the rust inhibitor of this invention is selected such that the effectiveness of the rust inhibitor is improved. Generally, the amount of solubility improver is less than 50 wt % of the total mixture when blended into a lubricating base oil to make a lubricant. Preferably, the amount of solubility improver is between about 0.10 and about 20 wt % of the total mixture, more preferably between about 0.10 and about 15 wt %. In one embodiment, when the solubility improver has an aniline point less than 10° C., it may be used at an even lower amount; preferably between about 0.10 and about 10 wt %, or preferably in an amount between about 0.10 and about 5 wt %, or in some cases in an amount between about 0.10 and 2 wt % of the total mixture when mixed with lubricating base oil.

Synthetic Lubricant Solubility Improvers:

Examples of synthetic lubricant solubility improvers that are useful in the rust inhibitor of this invention are alkylated aromatics, organic esters, alkylated cyclopentadiene and alkylated cyclopentene. Alkylated aromatics are synthetic lubricants produced from the alkylation of aromatics with haloalkanes, alcohols, or olefins in the presence of a Lewis or Bronsted acid catalyst. An overview of alkylated aromatic lubricants is given in *Synthetic Lubricants and High-Performance Functional Fluids*, edited by Ronald L. Shubkin, 1993, pp 125-144, incorporated herein. Useful examples of alkylated aromatics are alkylated naphthalene and alkylated benzene. Non-limiting examples of alkylated naphthalenes that are effective in the rust inhibitors of this invention are Mobil MCP-968, ExxonMobil Synesstic™ 5, ExxonMobil Synesstic™ 12, and mixtures thereof. Synesstic™ is a trademark of ExxonMobil Corporation.

Organic esters from animal or vegetable sources have been used as lubricants for over 4000 years. The polar nature of esters makes them excellent solubility improvers. Naturally occurring organic esters are found in animal fats such as sperm oil and lard oil, or in vegetable oils such as rapeseed and castor oil. Organic esters are synthesized by reacting organic acids with alcohols. The aniline point and other properties of the organic ester are affected by the acid and alcohol choices. The organic esters useful in this invention are solubility improvers with aniline points less than 100° C., preferably less than 50° C., more preferably less than 20° C. An overview of organic esters is given in *Synthetic Lubricants and High-Performance Functional Fluids*, edited by Ronald L. Shubkin, 1993, pp 41-65, incorporated herein. Types of synthetic organic esters include monoester, diester, phthalate, trimellitate, pyromellitate, dimerate, polyol, and polyoleate. Specific examples of monoesters are 2-ethyl pelargonate, isodecyl pelargonate, and isotridecyl pelargonate. Monoesters are made by reacting monohydric alcohols with monobasic fatty acids creating a molecule with a single ester linkage and linear or branched alkyl groups. These products are generally very low in viscosity (usually under 2 cSt at 100° C.) and exhibit extremely low pour points and high VIs. Diesters are made by reacting monohydric alcohols with dibasic acids creating a molecule which may be linear, branched, or aromatic and with two ester groups. The more common diester types are adipates, azelates, sebacates, dodecanedioates, phthalates, and dimerates. The term "polyol esters" is short for neopentyl polyol esters which are made by reacting monobasic fatty acids with polyhedric alcohols having a "neopentyl" structure. Like diesters, many different acids and alcohols are available for manufacturing polyol esters and indeed an even greater number of permutations are possible due to the multiple ester linkages. Unlike diesters, polyol esters are named after the alcohol instead of the acid and the acids are often represented by their carbon chain length. For example, a polyol ester made by reacting a mixture of nC8 and nC10 fatty acids with trimethylolpropane would be referred to as a "TMP" ester and represented as TMP C8C10. TMP tri fatty acid esters are preferred solubility improvers of this invention. The following table shows the most common materials used to synthesize polyol esters.

POLYOL ESTERS AND AVAILABLE ACIDS

| Common Alcohols | # of Ester Groups | Family | Available Acids |
|---|---|---|---|
| Neopentyl Glycol | 2 | NPG | Valeric (nC5) |
| Trimethylolpropane | 3 | TMP | Isopentanoic (iC5) |
| Pentaerythritol | 4 | PE | Hexanoic (nC6) |
| DiPentaerythritol | 6 | DiPE | Heptanoic (nC7) |
| | | | Octanoic (nC8) |
| | | | Isooctanoic (iC8) |
| | | | 2-Ethylhexanoic (2EH) |
| | | | Pelargonic (nC9) |
| | | | Isononanoic (iC9) |
| | | | Decanoic (nC10) |

Alkylated cyclopentadiene or alkylated cyclopentene are synthetic base oils having low aniline points that make good solubility improvers for use in the rust inhibitor of this invention. Examples of base oils of this type are described in U.S. Pat. Nos. 5,012,023, 5,012,022, 4,929,782, 4,849,566, and 4,721,823, incorporated herein in their entirety.

Mixture of Amine Phosphates:

The rust inhibitor of this invention comprises a mixture of amine phosphates. The mixture contains more than one alkyl or aryl amine phosphate. The mixture of amine phosphates is capable of forming films or complexes on metal surfaces, preferably on steel surfaces. The mixture of amine phosphates is present in the rust inhibitor in an amount such that when it is mixed with the other components of the rust inhibitor it contributes to the rust inhibition. Preferably, the amount of the mixture of amine phosphates is between about 0.001 wt % and about 2 wt % in the total mixture, when the rust inhibitor is mixed with lubricating base oil to make a finished lubricant. A preferred mixture of amine phosphates is a mixture of mono and diacid amine phosphate salts. Preferably the mixture of amine phosphates is food grade. Non-limiting examples of mixtures of amine phosphates that are effective in the rust inhibitors of this invention are NA-LUBE® AW 6010, NA-LUBE® AW 6110, Vanlube® 672, Vanlube® 692, Vanlube® 719, Vanlube® 9123, Ciba® IRGALUBE® 349, Additin® RC 3880, and mixtures thereof. Ciba® IRGALUBE® 349 is described in detail in U.S. Patent Application US20040241309. NA-LUBE® is a registered trademark of King Industries Specialty Chemicals. Vanlube® is a registered trademark of R.T. Vanderbilt Company, Inc. Ciba® and IRGALUBE® are registered trademarks of Ciba Specialty Chemicals Holding Inc. Additin® is a registered trademark of RheinChemie Rheinau GmbH.

Alkenyl Succinic Compound:

The rust inhibitor of this invention comprises an alkenyl succinic compound selected from the group consisting of an acid half ester, an anhydride, an acid, and mixtures thereof. Alkenyl succinic compounds useful in this invention are corrosion inhibitors that work by interacting with metal surfaces to form a protective chemical film.

Succinic acid [110-15-6] (butanedioic acid; 1,2-ethanedicarboxylic acid; amber acid), $C_4H_6O_4$, occurs frequently in nature as such or in the form of its esters. Succinic anhydride [108-30-5] (3,4-dihydro-2,5-furandione; butanedioic anhydride; tetrahydro-2,5-dioxofuran; 2,5-diketotetrahydrofuran; succinyl oxide), $C_4H_4O_3$, was first obtained by dehydration of succinic acid. Succinic acid and its anhydride are characterized by the reactivity of the two carboxylic functions and of the two methylene groups. Alkenyl succinic acid half ester, alkenyl succinic anhydride, and alkenyl succinic acid are derived from succinic acid or succinic anhydride. Examples of the preparation of some of the alkenyl derivatives are described in EP765374B1. Hereby incorporated in its entirety. One example of a useful polyalkenyl succinic anhydride molecule is polyisobutylene succinic anhydride (PIBSA) where the polyisobutylene group has a molecular weight of 900-1500.

Preferred alkenyl succinic compounds are acid half esters that work in combination with phenolic antioxidants and/or metal deactivators. One non-limiting example of this type of preferred alkenyl succinic acid half ester is Ciba® IRGACOR® L-12. Ciba® IRGACOR® L-12 is a clear, viscous yellow to brown liquid with a kinematic viscosity of about 1500 cSt at 40° C.

The amount of alkenyl succinic acid half ester, alkenyl succinic anhydride, alkenyl succinic acid, or mixtures thereof is selected to provide improved rust inhibition when mixed with the other components of the rust inhibitor. Preferably the amount of alkenyl succinic acid half ester, succinic anhydride, alkenyl succinic acid, or mixtures thereof is between about 0.0005 wt % and about 1.0 wt % (more preferably between about 0.001 wt % and about 0.5 wt %) of the total mixture, when blended with lubricating base oil. The preferred alkenyl group in the alkenyl succinic acid half ester, alkenyl succinic anhydride, alkenyl succinic acid, or mixtures thereof has between 3 and 100 carbons, more preferably between 5 and 25 carbon atoms.

The specifications for Lubricating Base Oils are defined in the API Interchange Guidelines (API Publication 1509).

| API Group | Sulfur, ppm | | Saturates, % | VI |
|---|---|---|---|---|
| I | >300 | And/or | <90 | 80-120 |
| II | ≦300 | And | ≧90 | 80-120 |
| III | ≦300 | And | ≧90 | >120 |
| IV | All Polyalphaolefins (PAOs) | | | |
| V | All Base Oils Not Included in API Groups I-IV | | | |

Polyinternal olefins (PIOs) are a new class of synthetic lubricating base oil with similar properties to polyalphaolefins. PIOs are made from different feedstocks with higher molecular weight olefins than PAOs. PIOs use internal $C_{15}$ and $C_{16}$ olefins, while PAOs typically use $C_{10}$ alpha olefins.

Finished lubricants generally comprise a lubricating base oil and at least one additive. Finished lubricants are lubricants used in equipment such as automobiles, diesel engines, gas engines, axles, transmissions, and a wide variety of industrial applications. Finished lubricants must meet the specifications for their intended application as defined by the concerned governing organization. One of the specifications that is frequently encountered is the requirement for a passing result in either the TORT A and/or TORT B rust tests by ASTM D 665-02. The TORT B rust test is the more severe test for rust inhibition of a finished lubricant.

The finished lubricants of this invention may contain one or more lubricant additives in addition to the rust inhibitor of this invention. Additives which may be additionally blended with the finished lubricant composition include those which are intended to improve certain properties of the finished lubricant. Typical additives include, for example, thickeners, VI improvers, antioxidants, corrosion inhibitors, metal deactivators, detergents, dispersants, extreme pressure (EP) agents, pour point depressants, seal swell agents, demulsifiers, antiwear agents, lubricity agents, antifoam agents, and the like. Typically, the total amount of additives (including the rust inhibitor) in the finished lubricant will fall within the range of from about 1 to about 30 weight percent. The use of additives in formulating finished lubricants is well documented in the literature and well within the ability of one skilled in the art. Therefore, additional explanation should not be necessary in this disclosure.

The rust inhibitor of this invention is especially useful in a wide variety of finished industrial lubricants, for example: compressor, bearing, paper machine, turbine, hydraulic, circulating, or gear oil. A number of industrial lubricants have higher kinematic viscosities and also have demanding specifications for (or highly desired) rust inhibition.

In one embodiment, for the first time, this invention provides a finished lubricant that passes the 4 hour TORT B rust test having a kinematic viscosity at 40° C. between about 90 cSt (ISO 100) and higher comprising greater than 65 weight percent (or greater than 90 weight percent) API Group III, API Group IV, polyinternal olefin base oil, or mixtures thereof; and between about 0.10 wt % and about 5 wt % solubility improver having an aniline point less than 50° C. With the addition of thickeners the finished lubricant of this invention may have a kinematic viscosity at 40° C. as high as ISO 46,000. Preferably the finished lubricant will have a kinematic viscosity at 40° C. between about 90 cSt (ISO 100) and 1700 cSt (ISO 1500 and greater). More preferably the finished lubricant of this embodiment of the invention has a kinematic viscosity at 40° C. between about 198 cSt (ISO 220) and 1700 cSt, even more preferably between about 414 cSt (ISO 460) and 1700 cSt. Generally the higher the kinematic viscosity of the finished lubricant, the more difficult it is to obtain effective rust inhibition; making this invention especially valuable. Desirable finished lubricants of this embodiment of this invention may be industrial oils such as: compressor, bearing, paper machine, turbine, hydraulic, circulating, or gear oils. Preferred embodiments will have an absolute value of the copper weight change by ASTM D 2619-95 less than or equal to 0.10 milligrams per square centimeter and an ASTM color by ASTM D 1500-98 of 1.0 or less.

In another embodiment, for the first time, this invention provides a finished lubricant passing the 4 hour TORT B rust test comprising a major amount of hydroisomerized Fischer-Tropsch wax, Fischer-Tropsch oligomerized olefins or mixture thereof; and between about 0.10 and about 5 wt % of a solubility improver having an aniline point less than 10° C. The finished lubricants of this embodiment may range in kinematic viscosity anywhere from about 13.5 cSt (ISO 15) to about 1700 cSt (ISO 1500 and greater) at 40° C. The finished lubricants of this embodiment may be industrial oils, for example: compressor, bearing, paper machine, turbine, hydraulic, circulating, or gear oil. Preferably, the finished lubricant of this embodiment of this invention comprising a major amount of hydroisomerized Fischer-Tropsch wax will also pass the 24 hour TORT B rust test. Surprisingly, one preferred finished lubricant of this embodiment is an oil meeting the requirements of MIL-PRF-17331J.

In preferred embodiments of this invention the finished lubricants have a very light color, preferably an ASTM color by ASTM D 1500-02 of 1.0 or less. ASTM color is an important quality characteristic of lubricating base oils and finished lubricants since color is readily observed by users of the products. It is measured by ASTM D 1500-02. Customers often associate light color with product quality and show a preference for lighter colored products. Preferred finished lubricants of this invention also resist copper corrosion. When tested according to ASTM D 2619-95 (2002) they have an absolute value of the copper weight change of less than or equal to 0.10 milligrams per square centimeter, preferably less than or equal to 0.05 milligrams per square centimeter.

Oil meeting the requirements of MIL-PRF-17331J is an example of a finished lubricant of this invention that may now be successfully blended using a major amount of highly paraffinic lubricating base oil. Oil meeting the requirements of MIL-PRF-17331J is the most widely used lubricant within the US Navy (approx. 12,000 gallons per vessel) and has the highest disposal volume. It is a turbine oil primarily used as a circulating system oil for marine gear turbine sets. The requirements of MIL-PRF-17331J include a specification that the fluid must pass a 24 hour TORT B rust test, and a water wash rust test. MIL-PRF-17331 is a specification for circulating oil. In preferred embodiments, the finished oils of this invention are able to meet this specification.

Hydroisomerized Fischer-Tropsch Wax: Hydroisomerized Fischer-Tropsch waxes are lubricating base oils with high viscosity index, low pour point, excellent oxidation stability, and low volatility, comprising saturated components of iso-paraffinic and optionally cyclo-paraffinic character. Hydroisomerization of Fischer-Tropsch waxes have been well reported in the literature. Examples of processes for the preparation of hydroisomerized Fischer-Tropsch waxes are described in U.S. patent application Ser. Nos. 10/897,501, and 10/980,572; U.S. Patent Publication No. 20050133409; U.S. Pat. Nos. 5,362,378; 5,565,086; 5,246,566; 5,135,638; 5,282,958; and 6,337,010; as well as in EP 710710, EP 321302 and EP 321304; herein incorporated in their entirety. Preferred hydroisomerized Fischer-Tropsch waxes that meet white oil properties are described in U.S. patent application Ser. No. 10/897,501.

Fischer-Tropsch Oligomerized Olefins: Olefins produced from Fischer-Tropsch products may be oligomerized to produce base oils with a broad range of viscosities, high VI and excellent low temperature properties. Depending upon how a Fischer-Tropsch synthesis is carried out, the Fischer-Tropsch condensate will contain varying amounts of olefins. In addition, most Fischer-Tropsch condensate will contain some alcohols which may be readily converted into olefins by dehydration. The condensate may also be olefin enriched through a cracking operation, either by means of hydrocracking or more preferably by thermal cracking. During oligomerization the lighter olefins are not only converted into heavier molecules, but the carbon backbone of the oligomers will also display branching at the points of molecular addition. Due to the introduction of branching into the molecule, the pour point of the products is reduced.

The oligomerization of olefins has been well reported in the literature, and a number of commercial processes are available. See, for example, U.S. Pat. Nos. 4,417,088; 4,434,308; 4,827,064; 4,827,073; 4,990,709; 6,398,946, 6,518,473 and 6,605,206. Various types of reactor configurations may be employed, with either fixed catalyst bed or ionic liquid media reactors used.

In another embodiment this invention provides a novel method of improving the rust inhibition of a lubricating oil. A lubricating oil that does not pass the 4 hour TORT B rust test may be improved by this method such that it consistently passes the 4 hour TORT B rust test. This method comprises incorporating between about 0.10 wt % and about 10 wt %, based on the total weight of the lubricating oil, of a solubility improver having an aniline point less than 10° C., preferably less than 5° C., to a lubricating base oil. We have discovered that the solubility improver may comprise for example one or more phenolic antioxidants. This method is particularly useful when used in a lubricating oil having a major amount of highly paraffinic base oil. As previously disclosed, examples of highly paraffinic base oils are API Group II base oils having greater than 65% paraffinic chain carbons by ASTM D 3238, API Group III base oils having greater than 65% paraffinic chain carbons by ASTM D 3238, polyinternal olefin base oils, API Group IV base oils, and mixtures thereof. Other examples of highly paraffinic base oils that may be benefited by this method are hydroisomerized Fischer-Tropsch wax base oil, Fischer-Tropsch oligomerized olefin base oil, or mixture thereof. In preferred embodiments the method of this invention enables the lubricating oil to additionally pass a 24 hour TORT B rust test.

EXAMPLES

Example 1, Example 2, and Comparative Example 3

Three different blends (Examples 1, 2, and Comparative Example 3) of ISO 460 grade finished lubricant were prepared. All three of the blends contained an identical additive package, other than the rust inhibitor; and the same lubricating base oil. The lubricating base oil was a mixture of 30.4 wt % Chevron UCBO 7 and 69.6 wt % Mobil SHF 1003. Chevron UCBO 7 is an API Group III base oil with about 86% paraffinic chain carbons by ASTM D 3238. Mobil SHF 1003 is an API Group IV base oil (PAO). The additive package without the rust inhibitor was added to the lubricating base oil at a treat rate of 1.35 wt %. The additives in the additive package (without the rust inhibitor) were antioxidants, an EP agent, a pour point depressant, and an antifoam agent.

The rust inhibitors were slightly different in each of the three blends. The weight percents of each component of the rust inhibitor in the finished oil blends were as follows:

TABLE I

| Rust Inhibitor Component | Commercial Trade Name | Wt % |
|---|---|---|
| Mixture of mono and diacid amine phosphate salts | Ciba ® IRGALUBE ® 349 | 0.01 |
| Alkenyl succinic acid half ester solution in mineral oil | Ciba ® IRGACOR ® L-12 | 0.075 |
| Solubility Improver | varies | 5.0 |

Ciba ®, IRGALUBE ®, and IRGACOR ® are registered trademarks of Ciba Specialty Chemicals Holding Inc.

Examples 1 & 2 are examples of finished lubricants of this invention and they both comprise the rust inhibitor of this invention. Example 1 has Mobil MCP-968, alkylated naphthalene, as the solubility improver. Example 2 has Emery® 2925 as the solubility improver. Emery® 2925 is TMP tri fatty acid ester, a form of polyol ester. Emery® is a registered trademark of Cognis Corporation.

Comparative Example 3 is not an example of a finished lubricant of this invention, nor does it contain the rust inhibitor of this invention. Comparative Example 3 has a rust inhibitor made of Ciba® IRGALUBE® 349, Ciba® IRGACOR® L-12 and Citgo Bright Stock 150. Citgo Bright Stock 150 is an API Group I base oil. It is not an example of the solubility improver of this invention as it has an aniline point of 127° C., well above the aniline point of 100° C. that is required.

Properties of the three different solubility improvers used in Example 1, Example 2, and Comparative Example 3 are shown in Table II.

TABLE II

| Property | Mobil MCP-968 | Emery ® 2925 | Citgo Bright Stock 150 |
|---|---|---|---|
| Kinematic Viscosity at 100° C., D 445 | 13.0 | 4.4 | 31.2 |
| Viscosity Index, D 2270 | 108 | 136 | 98 |
| Aniline Point, ° C., D 611 | 84 | 0 | 127 |
| Pour Point, ° C., D 5950 | −33 | −57 | −15 |

The three different blends of ISO 460 grade finished lubricant were tested in duplicate in 4 hour and 24 hour TORT B rust tests by ASTM D 665-02. The results of these analyses are shown in the following table, Table III.

TABLE III

| Performance Tests | Example 1 | Example 2 | Comparative Example 3 |
|---|---|---|---|
| Viscosity at 40 C., cSt, D 445 | 433.08 | 430.1 | 438.5 |
| 4 hour TORT B Rust, D 665-02 | Pass/Pass | Pass/Pass | Fail/Pass |
| 24 hour TORT B Rust, D 665-02 | Fail/Pass | Pass/Pass | Fail/Fail |

The results for Examples 1 and 2 show the effectiveness of the rust inhibitor of this invention to completely prevent rust in the 4 hour TORT B rust tests. The Comparative Example 3 gave inconsistent results in duplicate 4 hour TORT B rust tests. The 24 hour TORT B rust tests demonstrated that the rust inhibitor including Emery® 2925 as the solubility improver gave better rust protection than the rust inhibitor including Mobil MCP-968. Emery® 2925 had the lowest aniline point of the two solubility improvers tested, demonstrating that the lower the aniline point of the solubility improver used in the rust inhibitor and finished lubricants comprising it, the better the rust inhibition.

Three identical blends of Example 1, Example 2, and Comparative Example 3 were made and tested for kinematic viscosity, color, and hydrolytic stability. The results of these analyses are shown below, in Table IV.

TABLE IV

| Performance Tests | Example 1 | Example 2 | Comparative Example 3 |
|---|---|---|---|
| Viscosity at 40 C., cSt, D 445 | 437.1 | 433.6 | 444.2 |
| ASTM Color, D 1500 | L 0.5 | L 0.5 | L 1.5 |
| Hydrolytic Stability, D 2619-95 | | | Not tested |
| Copper Wt. Change | −0.02 | −0.006 | |
| Insolubles, mg | 6.9 | 6.4 | |
| Acid Number Change, D 974 | −0.12 | −0.07 | |
| Viscosity Change at 40 C. | 0.34 | −0.07 | |
| Copper Appearance, D 130 | 1b | 1b | |

The finished lubricants comprising the rust inhibitor of this invention also had good hydrolytic stability, very light color, and low copper corrosivity. Comparative Example 3 had a darker color, which is less preferred.

Example 4

Properties of two different solubility improvers and a 50/50 blend of the two solubility improvers are shown below in Table V. Both the solubility improvers are commercially available as liquid phenolic antioxidants.

TABLE V

| Property | Liquid phenolic antioxidant #1 | Liquid phenolic antioxidant #2 | 50/50 Mix |
|---|---|---|---|
| Kinematic Viscosity at 100° C., D 445 | 123 | | |
| Aniline Point, ° C., ASTM D 611 | <2 | <2 | <2 |

The aniline point of the individual liquid phenolic antioxidants and the blend were extremely low, indicating high effectiveness as solubility improvers in this invention.

The 50/50 mix of liquid phenolic antioxidants shown in Table V was blended into a finished lubricant meeting the requirements of MIL-PRF-17331J. The composition of the formulated MIL-PRF-17331J fluid is shown in Table VI.

TABLE VI

| | Further Description | Wt % |
|---|---|---|
| Rust Inhibitor Components | | |
| Mixture of amine phosphates | Ciba ® IRGALUBE ® 349 | 0.01 |
| Alkenyl succinic acid half ester solution in mineral oil | Ciba ® IRGACOR ® L-12 | 0.08 |
| Solubility Improver | 50/50 mix of Liquid phenolic antioxidants #1 and #2 | 0.30 |
| Other Additives | | |
| Dialkyl dithiophosphate, ashless EP/antiwear additive | Antiwear agent | 0.03 |
| Tolutriazole derivative metal deactivator | Metal deactivator | 0.04 |
| Base Oil Components | | |
| Pennzoil 230-HC | API Group II base oil | 35.39 |
| Pennzoil 575-HC | API Group II base oil | 64.15 |
| TOTAL | | 100.00 |

After blending, a small amount of antifoam agent was added in the amount shown below.

| Antifoam Agent | Wt % |
|---|---|
| Dilution of polydimethylsiloxane polymeric foam inhibitor | 0.066 |

The two base oils used in the blend were API Group II base oils of moderate to high viscosity. The properties of the two base oils used in the blend are shown in Table VII.

TABLE VII

| | Base Oil Manufacturer Pennzoil | |
|---|---|---|
| Product Code | 230-HC | 575-HC |
| Kinematic Viscosity @ 40° C., cSt | 43.3 | 116.0 |
| Kinematic Viscosity @ 100° C., cSt | 6.50 | 12.5 |
| Viscosity Index | 101 | 98 |
| Pour Point, ° C., ASTM D 5850 | −12 | −12 |
| Paraffinic Chain Carbons, Wt %, ASTM D 3238 | 65.25 | 68.73 |

The blend of oil meeting the requirements of MIL-PRF-17331J was tested in duplicate in 4 hour and 24 hour TORT B rust tests by ASTM D 665-02. The results of these analyses are shown in the following table, Table VIII.

TABLE VIII

| Performance Tests | Example 4 |
|---|---|
| Viscosity at 40 C., cSt, D 445 | 79.80 |
| 4 hour TORT B Rust, D 665-02 | Pass/Pass |
| 24 hour TORT B Rust, D 665-02 | Pass/Pass |

These results show that an oil meeting the requirements of MIL-PRF-17331J may be blended successfully with the rust inhibitor of this invention. All previous blends of this finished lubricant using highly refined Group II base oils without the benefit of the rust inhibitor of this invention, had not consistently passed the stringent TORT B rust tests of MIL-PRF-17331J. It is notable that the amount of solubility improver that was used was very low (0.30 wt %), but because of its low aniline point (<2° C.), a small amount was still very effective.

These examples demonstrate the superior effectiveness of the rust inhibitor of this invention. The rust inhibitor is effective in highly paraffinic API Group II, API Group III, polyinternal olefin, and API Group IV base oils, and will also provide excellent rust inhibition in base oils made from hydroisomerized Fischer-Tropsch wax and Fischer-Tropsch oligomerized olefins.

All of the publications, patents and patent applications cited in this application are herein incorporated by reference in their entirety to the same extent as if the disclosure of each individual publication, patent application or patent was specifically and individually indicated to be incorporated by reference in its entirety.

Many modifications of the exemplary embodiments of the invention disclosed above will readily occur to those skilled in the art. Accordingly, the invention is to be construed as including all structure and methods that fall within the scope of the appended claims.

I claim:

1. A finished lubricant having a kinematic viscosity at 40° C. between about 414 cSt and 1700 cSt that passes the 4 hour TORT B rust test, comprising:

a) greater than 65 weight percent API Group III base oil, API Group IV base oil, polyinternal olefin base oil, or mixtures thereof; and b) between about 0.10 wt % and about 5 wt % solubility improver having an aniline point less than 50° C. and a kinematic viscosity within a lubricating base oil range of 2.0 to 75 cSt at 100° C.

2. A finished lubricant having a kinematic viscosity at 40° C. between about 90 cSt and 1700 cSt that passes the 4 hour TORT B rust test, comprising:

a) greater than 65 weight percent API Group III base oil, API Group IV base oil, polyinternal olefin base oil, or mixtures thereof; and b) between about 0.10 wt % and about 5 wt % solubility improver having an aniline point less than 2° C. and a kinematic viscosity within a lubricating base oil range of 2.0 to 75 cSt at 100° C.

3. A finished lubricant having a kinematic viscosity at 40° C. between about 90 cSt and 1700 cSt that passes the 4 hour TORT B rust test, comprising:

a) greater than 65 weight percent API Group III base oil, API Group IV base oil, polyinternal olefin base oil, or mixtures thereof; and b) between about 0.10 wt % and about 5 wt % solubility improver having an aniline point less than 50° C. and a kinematic viscosity within a lubricating base oil range of 2.0 to 75 cSt at 100° C.; and c) a mixture of amine phosphates, wherein the mixture of amine phosphates is a mixture of mono and diacid amine phosphate salts.

4. A finished lubricant having a kinematic viscosity at 40° C. between about 90 cSt and 1700 cSt that passes the 4 hour TORT B rust test, comprising:

a) greater than 65 weight percent API Group III base oil, API Group IV base oil, polyinternal olefin base oil, or mixtures thereof; and b) between about 0.10 wt % and about 5 wt % solubility improver having an aniline point less than 50° C. and a kinematic viscosity within a lubricating base oil range of 2.0 to 75 cSt at 100° C.; wherein the finished lubricant meets the requirements of the MIL-PRF-17331J specification.

5. The finished lubricant of claim 1, claim 2, claim 3, or claim 4, wherein said kinematic viscosity at 40° C. is between about 198 and 1700 cSt.

6. The finished lubricant of claim 1, claim 2, claim 3, or claim 4, comprising greater than 90 weight percent API Group III base oil, API Group IV base oil, polyinternal olefin base oil, or mixtures thereof.

7. The finished lubricant of claim 1, claim 2, claim 3, or claim 4, having an absolute value of the copper weight change by ASTM D 2619-95 less than or equal to 0.10 milligrams per square centimeter.

8. The finished lubricant of claim 1, claim 2, claim 3, or claim 4, having an ASTM color by ASTM D 1500-98 of 1.0 or less.

9. The finished lubricant of claim 1, claim 2, claim 3, or claim 4, wherein the solubility improver has an aniline point less than 20° C.

10. The finished lubricant of claim 1, claim 2, or claim 4, additionally comprising a mixture of amine phosphates.

11. The finished lubricant of claim 1, claim 2, claim 3, or claim 4, additionally comprising an alkenyl succinic acid half ester in a solution having a kinematic viscosity at 40° C. greater than 1000 cSt.

* * * * *